United States Patent [19]

Brown

[11] 4,049,238

[45] Sept. 20, 1977

[54] PORTA-CRANE

[76] Inventor: Harold E. Brown, 419 W. 101st St., Chicago, Ill. 60628

[21] Appl. No.: 726,698

[22] Filed: Sept. 27, 1976

[51] Int. Cl.[2] ..... B66C 23/60

[52] U.S. Cl. ..... 254/139.1; 212/8 R; 212/55; 212/65; 214/86 A

[58] Field of Search ..... 254/139.1; 212/8 R, 212/124, 140, 141, 55, 65; 214/86 R, 86 A; 280/402

[56] References Cited

U.S. PATENT DOCUMENTS

| | | | |
|---|---|---|---|
| 1,690,372 | 11/1928 | Livesay | 214/86 A |
| 2,740,535 | 4/1956 | Bill | 212/8 R |
| 2,907,473 | 10/1959 | Garnett | 254/139.1 |
| 3,092,367 | 6/1963 | Selby | 254/139.1 |
| 3,167,200 | 1/1965 | Booker | 254/139.1 X |
| 3,888,368 | 6/1975 | Hawkins | 214/86 A |

*Primary Examiner*—Robert J. Spar
*Assistant Examiner*—Donald W. Underwood

[57] ABSTRACT

A truck crane for use on a vehicle frame that includes a support frame including a pair of spaced apart support members, with means for pivotally mounting the support members at substantially one end thereof between operative and inoperative positions. To obtain various positions an extension device is cooperatively associated with the support members and includes a pair of extension members, each extension member and a respective support member being interfitted one within the other and being slidable and longitudinally adjustable relatively to its support member, so as to be adjustable between extended and retracted positions. Bridging means interconnecting the extension members at the free end is provided with releasably interconnecting means for retaining the support members and the extension members in longitudinally aligned extended and retracted positions.

Hydraulic means is pivotally connected at one end thereof to the vehicle frame and at the opposite end pivotally connected to the support members, so as to support the support frame in selected operative positions. Winch means is contained on the vehicle, and cable means having a hook at one end extending over the bridging means and connected to the winch means at the opposite end thereof is utilized.

3 Claims, 3 Drawing Figures

PORTA-CRANE

BACKGROUND OF THE INVENTION

The present invention relates to a truck crane and particularly to a truck crane that may be conveniently put into operation.

The portable crane in accordance with the present invention is pneumatically operated and compact for city street and expressway travel. This enables quick convenient and low cost travel to and from heavy lift sites which would normally take a larger piece of crane equipment such as flat-bed truck. Lifting equipment is usually slow running and awkward which hampers the natural flow of city traffic.

OBJECTS OF THE INVENTION

An object of the present invention is the provision of a truck crane which combines minimum clearance requirements with minimum encumbrance of the load space on the truck platform when the crane is inoperative.

Another object of the present invention is to provide a truck crane that may be manually assembled into operative position by the user.

Another object of the present invention is to provide a truck crane that may be secured to the rear of a vehicle and used for lifting considerable loads with a relatively lightweight vehicle.

Other objects and advantages of the present invention will become apparent as the disclosure proceeds.

SUMMARY OF THE INVENTION

A truck crane for use on a vehicle frame is disclosed that includes a support frame including a pair of spaced apart support members, with means for pivotally mounting the support members at substantially one end thereof between operative and inoperative positions. An extension device is cooperatively associated with the support members and includes a pair of extension members, each extension member and a respective support member being interfitted one within the other and being slidable and longitudinally adjustable relatively to it support member, so as to be adjustable between extended and retracted positions. Bridging means is provided for interconnecting the extension members at the free end thereof. Releasably interconnecting means for retaining the support members and the extension members in longitudinally aligned extended and retracted positions is utilized.

Hydraulic means is pivotally connected at one end thereof to the vehicle frame and at the opposite end pivotally connected to the support members, so as to support the support frame in selected operative positions. Winch means is contained on the vehicle having cable means with a hook at one end extending over the bridging means and connected to the winch means at the opposite end thereof, such that the support frame is adjustable in the operative position extending beyond the vehicle to the inoperative position in which the support frame is contained on the vehicle and the cable powered by the winch operates the hook in the operative position of the support frame.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
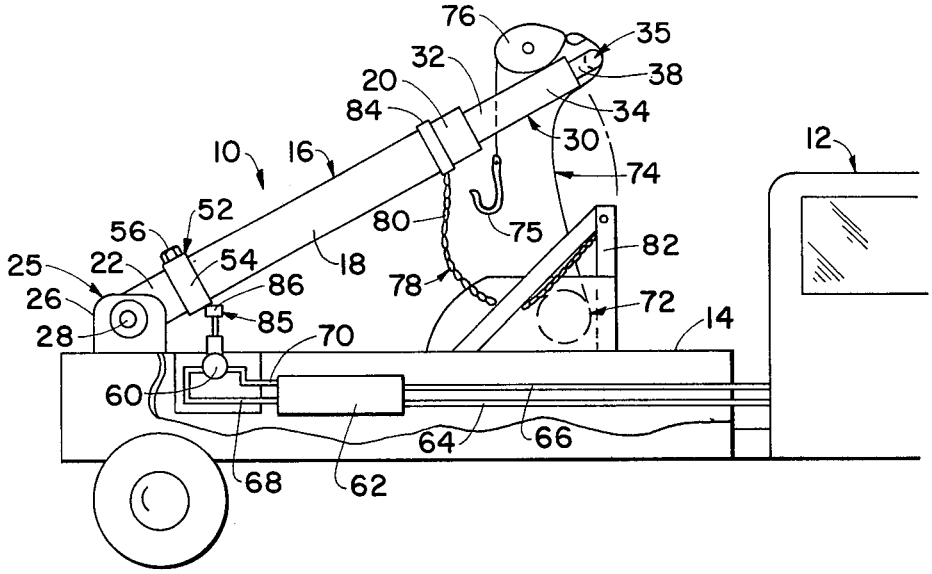
FIG. 1 is a diagrammatic side view of the truck crane in accordance with the present invention.
Figure 2:
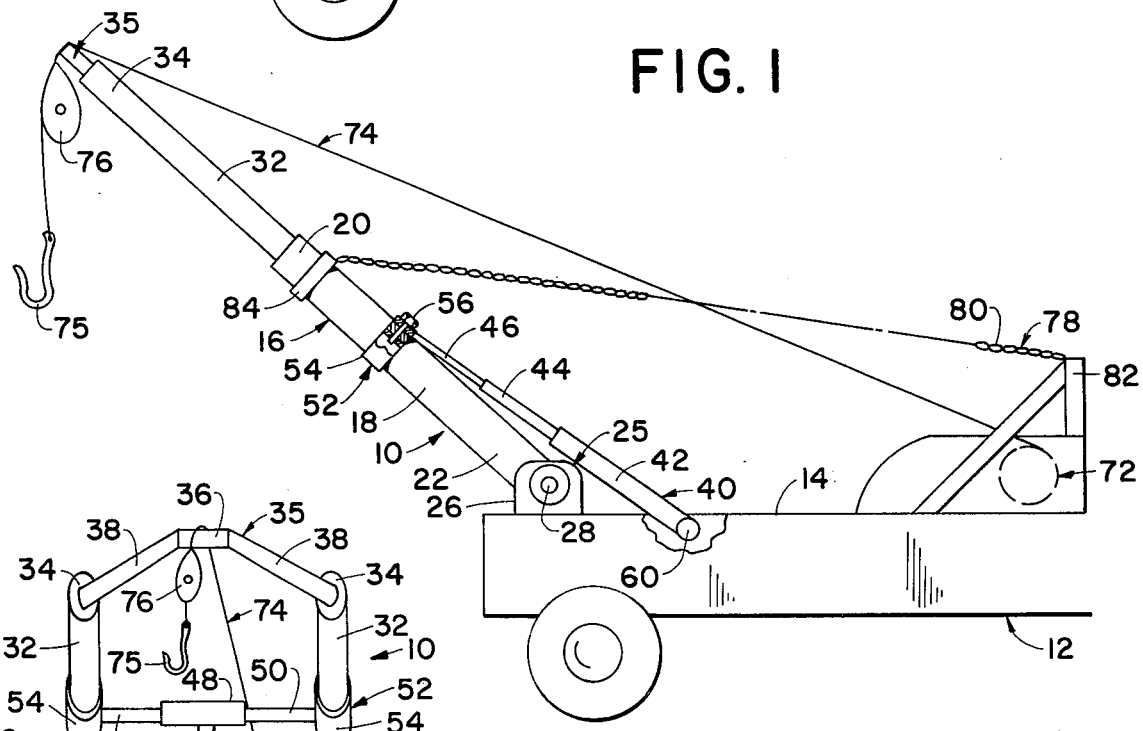
FIG. 2 is a side view similar to FIG. 1 showing the crane in its operative extended position.
Figure 3:
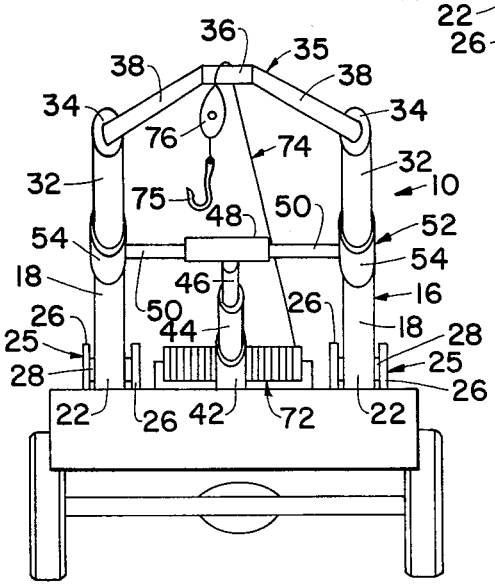
FIG. 3 is a rear view of the truck crane in its operative and extended position as illustrated in FIG. 2.

Referring now to FIGS. 1–3, there is illustrated a truck crane 10 mounted with respect to a vehicle frame 12 illustrated diagrammatically. The crane 10 is mounted relative to the rear portion 14 of the vehicle 12 and is designed in a manner to be easily assembled and brought into operational use and includes a support frame 16 including a pair of spaced apart support members 18 that may be tubular and of metal of sufficient wall thickness to be able to withstand the loads applied thereto.

The support frame 16 is adapted, as seen in FIG. 1, to be in an inoperative position and fully contained within the framework of the flat open portion of the vehicle frame 12. Each support member has a front end 20 and rear end 22. Pivotally mounting means 25 is contained on the rear portion 14 for pivotally mounting the support frame 16 between the inoperative position illustrated in FIG. 1 to the operative position illustrated in FIGS. 2 and 3. The pivotally mounting means includes a pair of vertically extending spaced apart brackets 26 with a transversely extending shaft 28 extending between said bracket 26 and through the lower end 22 of each respective support member 18. The support brackets 26 further act as means for maintaining the support members 18 is laterally spaced relation to each other by limiting the lateral motion of the support members 18.

An extension device 30 is cooperatively associated with the support members 18 and includes a pair of extension members of jibs 32. Each extension member 32 and a respective support member 18 being interfitted one within the other and being slidable and longitudinally adjustable relatively to its support member 18 so as to be adjustable between the extended position illustrated in FIGS. 2 and 3 and the retracted position illustrated in FIG. 1. The extension members 32 may also be made of an appropriate size tubular member or solid bar stock, that is made from metal.

Bridging means 35 is provided for interconnecting the extension member 32 at the free end 34 thereof. The bridging means 35 may include a central bridging member 36 that extends transversely to the direction of the extension members 32 with downwardly extending side bridging members 38 that interfit within the free end 34 of the extension members 32. In this manner the support frame 16 is pivotally mounted at one end thereof and is easily adjustable and manually assembled to be adjusted both into the operative position of the crane 10 and bringing the extension members 32 into the extended position illustrated in FIGS. 2 and 3.

To retain the support frame 16 in its operative position, hydraulic means 40 is provided between the vehicle frame 12 and the support frame 16. The hydraulic means 40 includes a hydraulic device or cylinder 42 having a longitudinally extending arm 44 with a con- K. cable means having a hook at one end extending over said bridging means and connected to said winch means at the opposite end thereof, such that said support frame is adjustable in the operative position extending beyond the vehicle to the inoperative position in which the said support frame is contained on the vehicle and said cable powered by said winch operates the hook in the operative position of said support frame, and L. adjustable securing means extending between the vehicle and said support frame.

2. A truck crane as defined in claim 1, and further including a pulley connected with said cable between said hook and said bridging means.

3. A truck crane as defined in claim 1, and further including wherein said adjustable securing means extending between the vehicle and the support frame is in the form of a chain so as to provide ease of adjustment in length thereof.

* * * * *